US006616004B1

(12) United States Patent
Erickson et al.

(10) Patent No.: US 6,616,004 B1
(45) Date of Patent: Sep. 9, 2003

(54) COMPRESSIBLE WASTE RECEPTACLE

(76) Inventors: Bradley E. Erickson, 1075-10$^{th}$ St., Oroville, CA (US) 95965; Brian L. Riley, 1075-10$^{th}$ St., Oroville, CA (US) 95965

( * ) Notice: Subject to any disclaimer, the term of this patent is extended or adjusted under 35 U.S.C. 154(b) by 0 days.

(21) Appl. No.: 10/122,010

(22) Filed: Apr. 15, 2002

(51) Int. Cl.$^{7}$ ..... B65D 6/16
(52) U.S. Cl. ..... 220/9.2; 220/666; 220/904
(58) Field of Search ..... 220/666, 667, 220/9.2, 904, 9.1, 9.3, 9.4

(56) References Cited

U.S. PATENT DOCUMENTS 216,227 A * 6/1879 Sedgwick ..... 220/9.2
3,014,516 A * 12/1961 Mueller ..... 220/9.2
5,960,983 A * 10/1999 Chan ..... 220/666
6,431,393 B1 * 8/2002 Stewart ..... 220/826
6,520,365 B2 * 2/2003 Schneider ..... 220/9.2

* cited by examiner

*Primary Examiner*—Joseph M. Moy

(57) ABSTRACT

A compressible waste receptacle for easily setting up and disposing waste-receiving members. The compressible waste receptacle includes a bag member having an open top, a closed bottom, and a rim disposed along an outer edge at the open top thereof; and also includes a biasedly-extended coiled spring member capable of being compressed onto itself and also being removably disposed in the bag member; and further includes an assembly for fastening the bag member to the biasedly-extended coiled spring member; and also includes an assembly to retain the biasedly-extended coiled spring member in a compressed position.

3 Claims, 2 Drawing Sheets

COMPRESSIBLE WASTE RECEPTACLE

BACKGROUND OF THE INVENTION

1. Field of the Invention

The present invention relates to waste receptacles and more particularly pertains to a new compressible waste receptacle for easily setting up and disposing waste-receiving members.

2. Description of the Prior Art

The use of waste receptacles is known in the prior art. More specifically, waste receptacles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,048,977; 5,022,767; 5,158,371; 5,352,043; Des. 356,251; and 4,940,200.

While these devices fulfill their respective, particular objectives and requirements, the aforementioned patents do not disclose a new compressible waste receptacle. The prior art discloses devices which have rigidly structured support members with the bag members being disposed about the rigidly structured support members. The rigidly structured support members cannot be compressed or collapsed into an easily handled waste receptacle. For example, if the user were traveling and wanted and needed to take along a waste receptacle which would not occupy much space, none of the prior art would be an acceptable waste receptacle.

In these respects, the compressible waste receptacle according to the present invention substantially departs from the conventional concepts and designs of the prior art, and in so doing provides an apparatus primarily developed for the purpose of easily setting up and disposing waste-receiving members.

SUMMARY OF THE INVENTION

The general purpose of the present invention, which will be described subsequently in greater detail, is to provide a new compressible waste receptacle which has many of the advantages of the waste receptacles mentioned heretofore and many novel features that result in a new compressible waste receptacle which is not anticipated, rendered obvious, suggested, or even implied by any of the prior art waste receptacles, either alone or in any combination thereof.

The inventive device includes a bag member having an open top, a closed bottom, and a rim disposed along an outer edge at the open top thereof; and also includes a biasedly-extended coiled spring member capable of being compressed onto itself and also being removably disposed in the bag member; and further includes an assembly for fastening the bag member to the biasedly-extended coiled spring member; and also includes an assembly to retain the biasedly-extended coiled spring member in a compressed position.

There has thus been outlined, rather broadly, the more important features of the compressible waste receptacle in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new compressible waste receptacle which has many of the advantages of the waste receptacles mentioned heretofore and many novel features that result in a new compressible waste receptacle which is not anticipated, rendered obvious, suggested, or even implied by any of the prior art waste receptacles, either alone or in any combination thereof.

Still another object of the present invention is to provide a new compressible waste receptacle for easily setting up and disposing waste-receiving members.

Still yet another object of the present invention is to provide a new compressible waste receptacle that is easy and convenient to use.

Even still another object of the present invention is to provide a new compressible waste receptacle that provides the user with a more sanitary and effective way to throw away trash.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
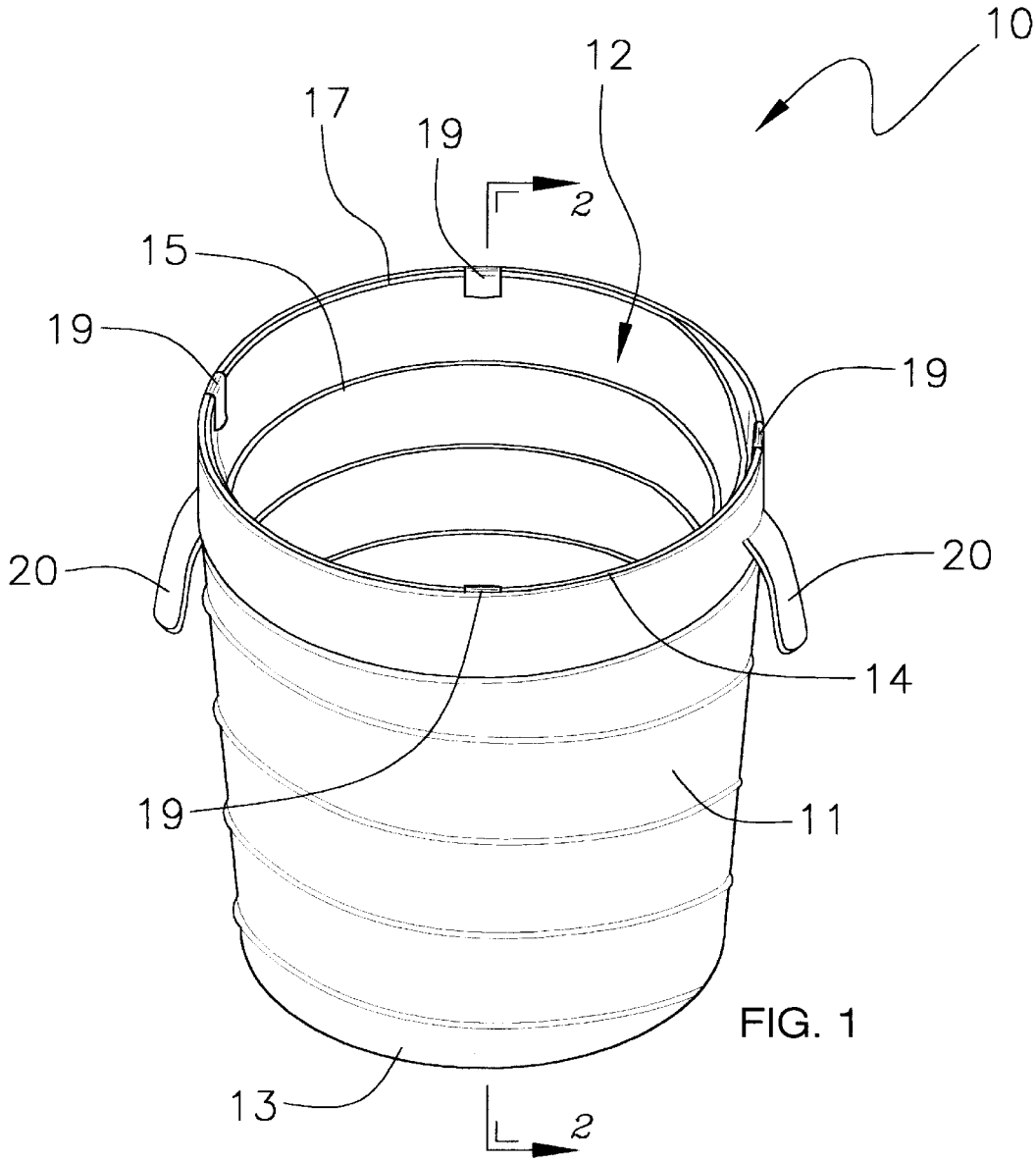
FIG. 1 is a perspective view of a new compressible waste receptacle according to the present invention and shown in use.
Figure 2:
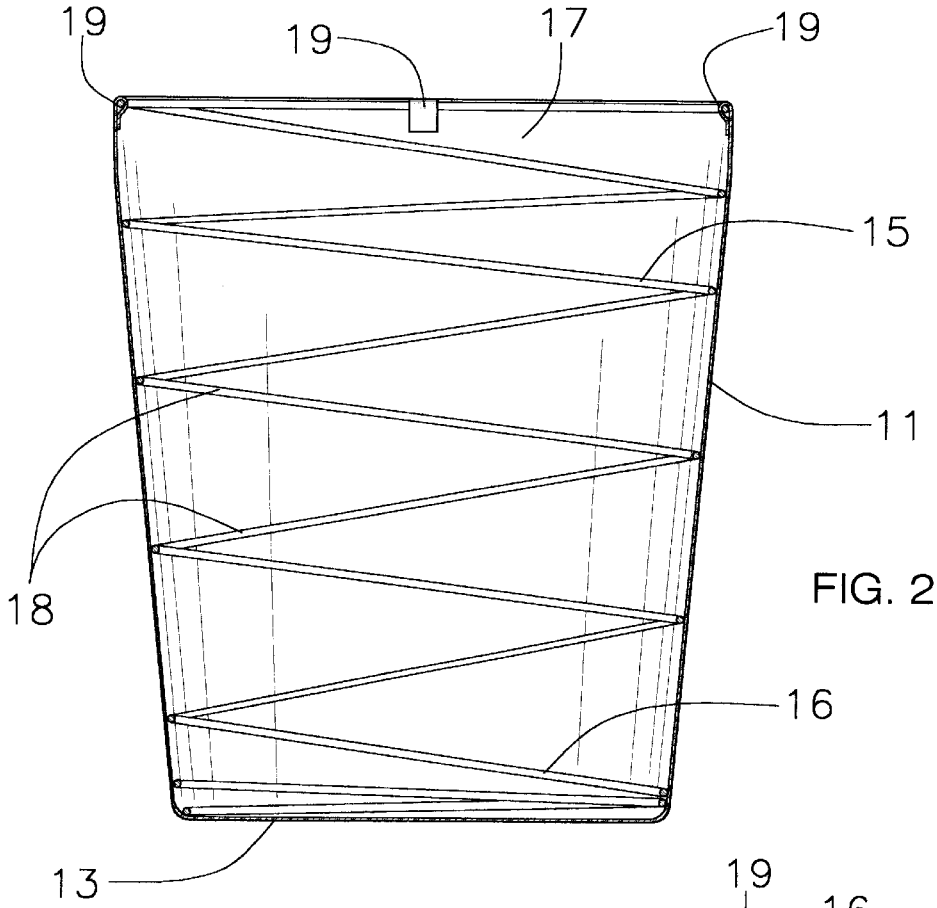
FIG. 2 is a cross-sectional view of the present invention.
Figure 3:
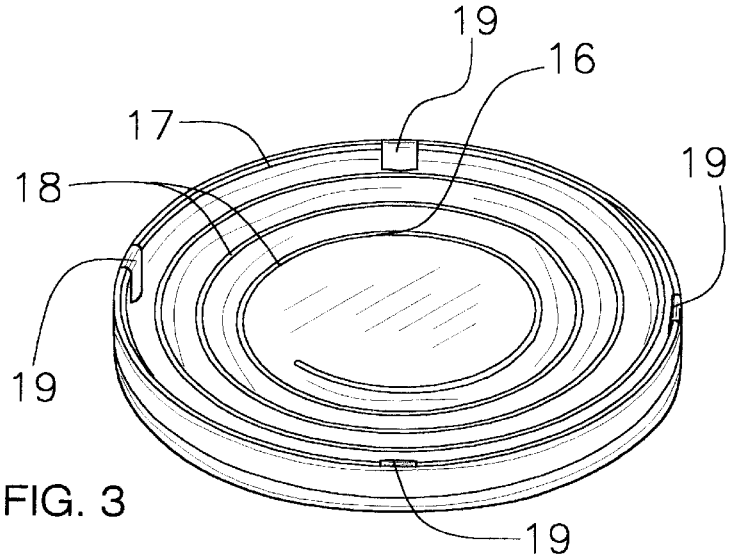
FIG. 3 is a perspective view of the present invention in a compressible position.

With reference now to the drawings, and in particular to FIGS. 1 through 3 thereof, a new compressible waste receptacle embodying the principles and concepts of the present invention and generally designated by the reference numeral 10 will be described.

As best illustrated in FIGS. 1 through 3, the compressible waste receptacle 10 generally comprises a bag member 11 having an open top 12, a closed bottom 13, and a rim 14 being disposed along an outer edge at the open top 12 thereof. A biasedly-extended coiled spring member 15 is capable of being collapsed onto itself and is also removably disposed in the bag member 11. The biasedly-extended coiled spring member 15 has an inner-extended section 16 which is positioned upon the closed bottom 13 in the bag member 11, and also has an outer-extended section 17 which is conventionally fastened to the rim 14 of the bag member 11, and further has an intermediate-extended section 18 which supports a wall of the bag member 11. The inner, outer, and intermediate-extended sections 16–18 of the biasedly-extended coiled spring member 15 lie substantially in a plane upon the biasedly-extended coiled spring member 15 being collapsed upon itself. The biasedly-extended coiled spring member 15 is generally a compressible cylindrical spiral member.

A means for fastening the bag member 11 to the biasedly-extended coiled spring member 15 includes a plurality of tab members 19 being spacedly and conventionally attached along the rim 14 of the bag member 11 and being foldable over the outer-extended section 17 of the biasedly-extended coiled spring member 15. A means to retain the biasedly-extended coiled spring member 15 in a compressed position includes a plurality of flexible ties 20 being wound about the inner, outer, and intermediate-extended sections 16–18 thereof.

In use, the user would untie the flexible ties 20 from about the inner, outer, and intermediate-extended sections 16–18; whereupon the biasedly-extended coiled spring member 15 springingly expands along with the bag member 11 so that garbage can be easily placed in the bag member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the compressible waste receptacle. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A compressible waste receptacle comprising:

a bag member having an open top, a closed bottom, and a rim disposed along an outer edge at the open top thereof;

a biasedly-extended coiled spring member capable of being compressed onto itself and also being removably disposed in the bag member, said biasedly-extended coiled spring member having an inner-extended section which is positioned upon said closed bottom in said bag member, and also having an outer-extended section which is fastened to said rim in said bag member, and further having an intermediate-extended section which supports a wall of said bag member, said inner, outer, and intermediate-extended sections of said biasedly-extended coiled spring member lying substantially in a plane upon said biasedly-extended coiled spring member being compressed upon itself;

a means for fastening said bag member to said biasedly-extended coiled spring member; and a means to retain said biasedly-extended coiled spring member in a compressed position.

2. A compressible waste receptacle as described in claim 1, wherein said biasedly-extended coiled spring member is generally a compressible cylindrical spiral member.

3. A compressible waste receptacle as described in claim 1, wherein said means to retain said biasedly-extended coiled spring member in a compressed position includes a plurality of flexible ties being wound about said inner, outer, and intermediate-extended sections thereof.

* * * * *